US005232298A

United States Patent [19]

Mitsunari et al.

[11] Patent Number: 5,232,298

[45] Date of Patent: Aug. 3, 1993

[54] APPLICATOR FOR APPLYING A LIQUID MEDIUM WITH VALVE FOR TUBE NOZZLES

[75] Inventors: Tomoharu Mitsunari, Ibaragi; Toshihiro Tsuchiya, Chiba, both of Japan

[73] Assignee: Kabushiki Kaisha Hoky, Chiba, Japan

[21] Appl. No.: 970,233

[22] Filed: Oct. 30, 1992

Related U.S. Application Data

[63] Continuation of Ser. No. 713,257, Jun. 13, 1991, abandoned.

[30] Foreign Application Priority Data

Jun. 15, 1990 [JP] Japan ..... 2-156900

[51] Int. Cl.[5] ..... A47L 13/30; A47L 13/22

[52] U.S. Cl. ..... 401/140; 251/9; 401/205; 401/207; 401/287

[58] Field of Search ..... 401/140, 205, 207, 287; 251/9

[56] References Cited

U.S. PATENT DOCUMENTS 2,641,011 6/1953 Caronia ..... 401/140 X
3,453,058 7/1969 Bixel .
3,690,779 9/1972 Ellis ..... 401/287 X

FOREIGN PATENT DOCUMENTS 0336661 10/1989 European Pat. Off. .
2341717 2/1975 Fed. Rep. of Germany ..... 401/140
3940123 6/1990 Fed. Rep. of Germany .
8605376 9/1986 PCT Int'l Appl. .
168233 8/1920 United Kingdom ..... 401/287

*Primary Examiner*—Steven A. Bratlie
*Attorney, Agent, or Firm*—Cushman, Darby & Cushman

[57] ABSTRACT

The present invention relates to an applicator for applying a liquid such as floor wax. When an operator adjusts a handle-mounted valve, drops of wax fall down from tube-shaped nozzles arranged in an equidistant relationship on the base of the applicator. The wax is supplied from a bag-shaped container mounted on an intermediate portion of the handle and flows down to the nozzles via filters, an adjusting valve, a distributing chamber and discharge passages. When the applicator is not in use, it is placed on a tray which keeps the base moist with a cloth tightly stretched on the base of the applicator. Steam fills the space between the cloth and the base to prevent solidification of the wax.

6 Claims, 10 Drawing Sheets

APPLICATOR FOR APPLYING A LIQUID MEDIUM WITH VALVE FOR TUBE NOZZLES

This is a continuation of application Ser. No. 713,257, filed on Jun. 13, 1991, now abandoned.

BACKGROUND OF THE INVENTION

1. Field of the Invention

The present invention relates to a liquid medium applicator for applying a liquid medium such as a wax, a detergent solution or the like to a floor surface. Further, the present invention relates to a tray for moistening the liquid medium applicator. In addition, the present invention relates to a cloth usable with the liquid medium applicator.

2. Description of the Related Art

A thread type mop and a wax applicator have been hitherto known as a liquid medium applicator for coating a floor surface with a film of wax.

When using a thread type mop, a mop portion is immersed in a wax solution and the floor surface is uniformly wiped with the mop portion impregnated with a wax. However, it has been found that the thread type mop has problems in that it is impregnated with an excessive quantity of wax solution and some spots on the floor surface fail to be coated with a film of wax. It is particularly important that the floor surface is uniformly coated with a thin film of wax. For this reason, a wax applying operation has required a highly trained skill.

A wax applicator which includes a base operatively secured to the foremost end of a rod-shaped grip handle, a cloth tightly expanded over the base to wipe the floor surface therewith, a wax storage tank firmly mounted on the intermediate part of the grip handle and a knob for opening or closing a wax flow passage extending from the wax storage tank down to outflow holes on the base has been developed. With this wax applicator constructed in the above-described manner, since a desired flow rate of wax can be set by adjusting an extent of opening of the wax flow passage, an adequate quantity of wax flows out through the outflow holes and thereby the floor surface is wiped with the cloth impregnated with the wax.

However, it has been found that the proposed wax applicator has the following problems. Generally, more than 75% of liquid wax is water. When water is vaporized after the floor surface is coated with a film of wax, the effective component, i.e., wax, is solidified and adhesively secured to the floor surface. This also happens to tools and instrument associated with the wax applicator. After a wax applying operation is completed, the wax should completely be removed from the tools and the instruments by a washing operation or the like. Alternatively, the tools and the instruments should be placed in a bag molded of polyvinyl chloride to prevent drying and solidification of the liquid wax. Especially, with respect to the wax applicator, when the liquid wax remains around the outflow holes on the base, it is locally solidified, causing some of the outflow holes to be clogged with the wax. As a result, the wax applicator does not function properly. (b) To assure that a wax applying operation is uniformly performed with a thin film of wax, a highly trained skill is required when the thread type mop is used. With respect to the wax applicator, no consideration has been hitherto given to a material employed for the wax applicator, a structure of the wax applicator, a method of squeezing the cloth via the grip handle held with an operator's hand and uniform impregnation of the cloth with the liquid wax. For this reason, it has been reported that the thread type mop operable by "a highly skilled operator" is superior to the wax applicator with respect to "a quality of finishing" after completion of the wax applying operation. The present tendency of the wax applicator which has been used for a wax applying operation may be summarized by the phrases "coating with a thick film of wax" and "irregular coating".

SUMMARY OF THE INVENTION

The present invention has been made in consideration of the aforementioned problems.

An object of the present invention is to provide a liquid medium applicator which assures that a liquid medium applying operation can uniformly be performed with a thin film of liquid medium.

Another object of the present invention is to provide a tray for moistening a liquid medium applicator wherein solidification of a liquid medium is reliably prevented and a complicated maintenance service is not required after completion of a liquid medium applying operation.

Another object of the present invention is to provide a cloth employable for a liquid medium applicator wherein a liquid medium applying operation can be performed conveniently.

According to a first aspect of the present invention, there is provided a liquid medium applicator including a base operatively connected to the lowermost end of a rodshaped grip handle, a cloth tightly expanded over the base for applying a liquid medium to a floor surface, a liquid medium container mounted on the grip handle or the base and an opening/closing mechanism for opening or closing liquid medium flow passages extending from the liquid medium container down to outflow holes on the base, wherein the liquid medium applicator further includes a plurality of tube nozzles arranged in the outflow holes on the base, each of the tube nozzles being molded of a soft thermoplastic synthetic resin, and a liquid medium feeding mechanism adapted to be actuated with an operator's hand to open or close the tube nozzles in the clamped state.

The liquid medium feeding mechanism comprises a trigger lever disposed at the upper end part of the grip handle to be depressed with an operator's finger and a movable pressure plate operatively connected to the trigger lever via connecting means to open or close the respective tube nozzles in the clamped state in cooperation with a stationary pressure plate. When the trigger lever is released from the depressed state, the tube nozzles are closed in the clamped state.

To facilitate dripping of the liquid medium from each tube nozzle while preventing the liquid medium from adhering thereto, each of the tube nozzles includes a tongue-shaped projection extending downward of the lower end thereof.

The liquid medium container is molded of a soft thermoplastic synthetic resin in the form of a hollow hermetic container.

The base of the liquid medium applicator includes a distributing chamber at the position above the bottom of a liquid medium storing portion. In addition, a plurality of discharge passages extend from the liquid medium distributing chamber to be communicated with the tube nozzles.

Additionally, the base of the liquid medium applicator includes two ribs extending the transverse direction and another two ribs extending in the forward/rearward direction of the base so that a series of outflow holes are arranged in the equally spaced relationship within the substantially rectangular region defined by the two ribs extending in the transverse direction and the two ribs extending in the forward/rearward direction of the base.

Further, according to another aspect of the present invention, there is provided a tray for moistening a liquid medium applicator, wherein the tray comprises a housing having an opening of which diameter is dimensioned to receive a base of the liquid medium applicator, a mass of water absorptive material received in the housing to be impregnated with water, and a tray bottom plate disposed on the mass of water absorptive material so as to allow a cloth tightly expended over the base of the liquid medium applicator to be placed on the tray bottom plate, the tray bottom plate having a number of ventilation holes formed thereon.

Furthermore, according to another aspect of the present invention, there is provided a cloth for a liquid medium applicator adapted to be tightly expanded over a base operatively connected to the lowermost end of a rod-shaped grip handle for the liquid medium applicator, the cloth being used to apply a liquid medium to a floor surface, wherein the cloth is woven using a number of threads each composed of very fine synthetic fibers.

To improve the utility of the cloth, the very fine synthetic fibers are subjected to shrinking and curling and they are then woven to a cloth having a towel-shaped structure.

In addition, to improve a property of water absorption, the very fine synthetic fibers are subjected to reforming and they are then woven to a cloth having a towel-shaped structure.

It is desirable that the rear surface of the cloth is lined with another cloth having excellent water absorptivity.

Since the liquid medium applicator of the present invention is constructed such that each tube nozzle in each outflow hole on the base is opened or closed in the clamped state by actuating the trigger lever with an operator's finger while the grip handle is held by the operator's other hand, there is no possibility that air is introduced into the fluid medium flow passage through the outflow holes when the liquid medium applicator is not in use.

In addition, since the liquid medium container is molded of a soft thermoplastic synthetic resin in the form of a hollow hermetic container and thereby the container itself contracts when the interior of the liquid medium container is increasingly evacuated as the fluid medium flows out therefrom, nothing prevents drops of the liquid medium from falling down without any necessity for forming air ventilation holes on the liquid medium container. Therefore, no air is introduced into the liquid medium flow passages at all, as long as a liquid medium inlet port is closed with a cap.

In a case where wax is used as a liquid medium, since the whole flow passage extending from an inlet port to an outlet port thereof is kept in the completely hermetic state, steam derived from vaporization of water contained in the hot wax is filled in the interior of the container having a limited space within a short period of time to immediately reach a saturated steam pressure while preventing further vaporization of water. As a result, solidification of the wax does not take place in the container.

Further, arrangement of tongue-shaped projections extending downward to the respective tube nozzles ensures that the remaining liquid wax falls down in the form of drops from the lowermost ends of the respective tongue-shaped projections. Thus, wax solidification during use of the applicator does not occur.

Since the liquid medium applicator is provided with a liquid medium feeding mechanism to open or close the flow passages by actuating the trigger lever with an operator's finger, a liquid medium applying operation can be performed at a high operational efficiency more easily. In addition, since the respective tube nozzles are kept closed while the trigger lever is released from the depressed state, there is no possibility that the liquid medium continues to flow out and the floor surface is excessively coated with the liquid medium.

Further, since the base of the liquid medium applicator is provided with a distributing chamber including a plurality of discharge passages communicated with the respective tube nozzles at a position higher than the bottom of a liquid storing portion, the liquid medium which has been introduced into the distributing chamber uniformly overflows to the respective tube nozzles via the liquid medium storing portion and the discharge passages and then uniformly flows out through the tube nozzles. This makes it possible that the floor surface is uniformly coated with the liquid medium without any irregularly coated spot.

Arrangement of two ribs extending in the transverse direction and another two ribs extending in the forward/rearward direction of the base within the substantially rectangular region on the base permits a cloth to be tightly expanded over the base with the aid of these ribs. This assures that the floor surface is uniformly coated with a thin film of liquid medium in the same manner as in a case where the floor surface is wiped with a so-called tightly squeezed floorcloth. It should be added that these ribs serve to prevent an extra quantity of liquid medium from permeating through the cloth not only in the forward/rearward direction but also in the transverse direction of the base.

With respect to the tray for moistening the liquid medium applicator in accordance with the present invention, while the base of the liquid medium applicator is placed on the bottom plate of the tray, steam is vaporized from water impregnated in a mass of water absorptive material and flows up through the ventilation holes on the tray bottom plate to reach the base of the liquid medium applicator through the cloth, whereby steam is filled in the space between the cloth and the base of the liquid medium applicator. This reliably prevents solidification of the liquid medium around the cloth and the tube nozzles. In addition, when a liquid medium applying operation is interrupted, the liquid medium applicator can be placed on the tray located near an operator. Thus, he can quickly start a liquid medium applying operation again. Consequently, the liquid medium applicator of the present invention can be used very conveniently.

Further, with respect to the cloth employable for the liquid medium applicator in accordance with the present invention, since the cloth is woven to form a towel-shaped structure using a number of threads each composed of very fine synthetic fibers which have been subjected to shrinking and curling, a property of water retention can be raised up by improving a property of water absorption of the fiber structure. In addition, since the cloth is very durable, a liquid medium applying operation can uniformly be performed with a thin film of liquid medium. Further, when the rear surface of the cloth is lined with an unwoven cloth or the like having an excellent property of water retention, a property of water retention of the cloth of the present invention can be improved substantially.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

Now, the present invention will be described in detail hereinafter with reference to the accompanying drawings which illustrate preferred embodiments thereof.

Figure 1:
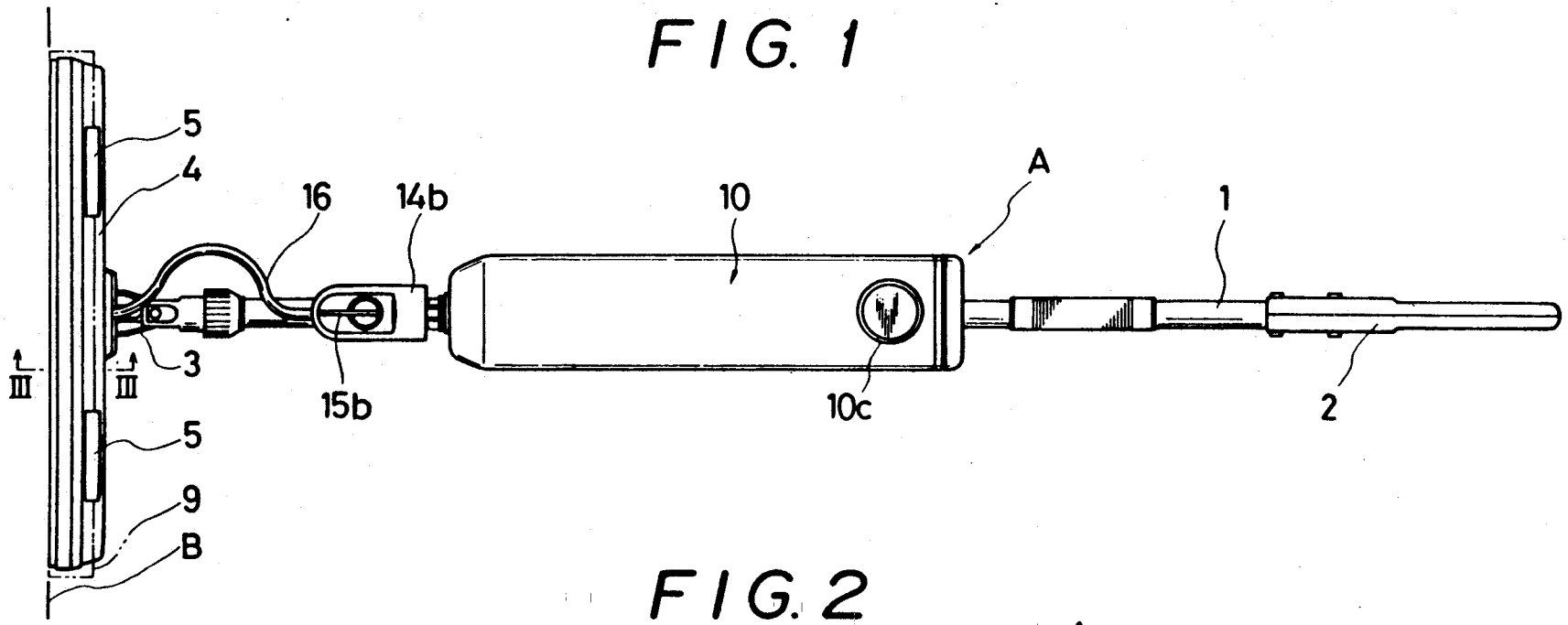
FIG. 1 is a front view of a wax applicator in accordance with an embodiment of the present invention.
Figure 2:
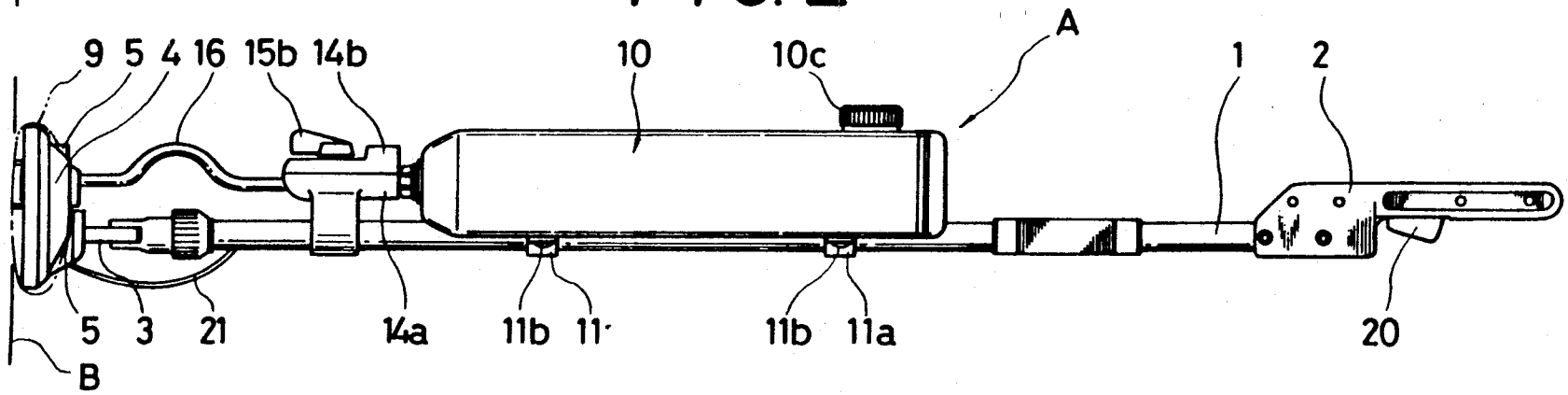
FIG. 2 is a side view of the wax applicator shown in FIG. 1.
Figure 3:
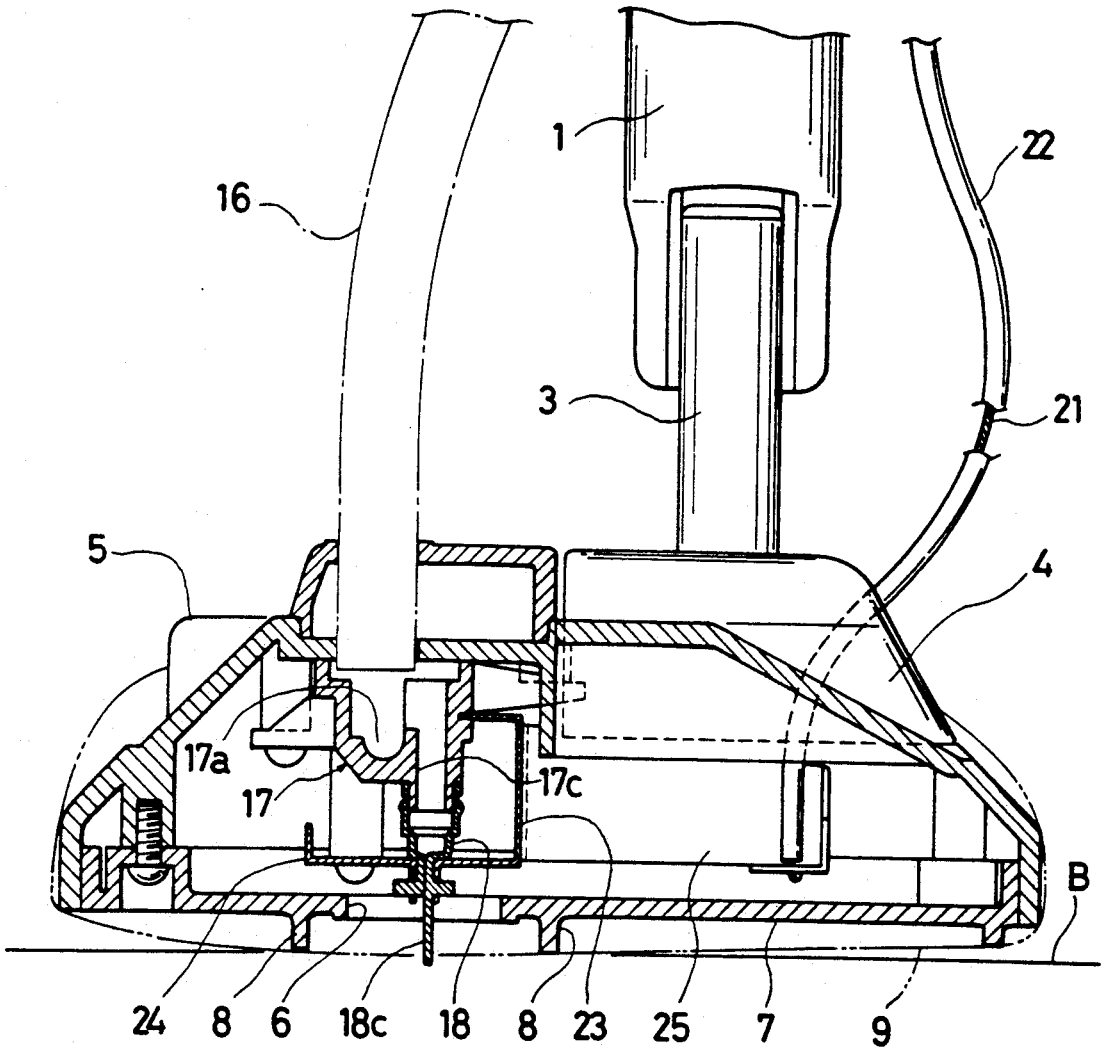
FIG. 3 is a fragmentary sectional view of the wax applicator taken along line III—IIIa in FIG. 1.
Figure 4:
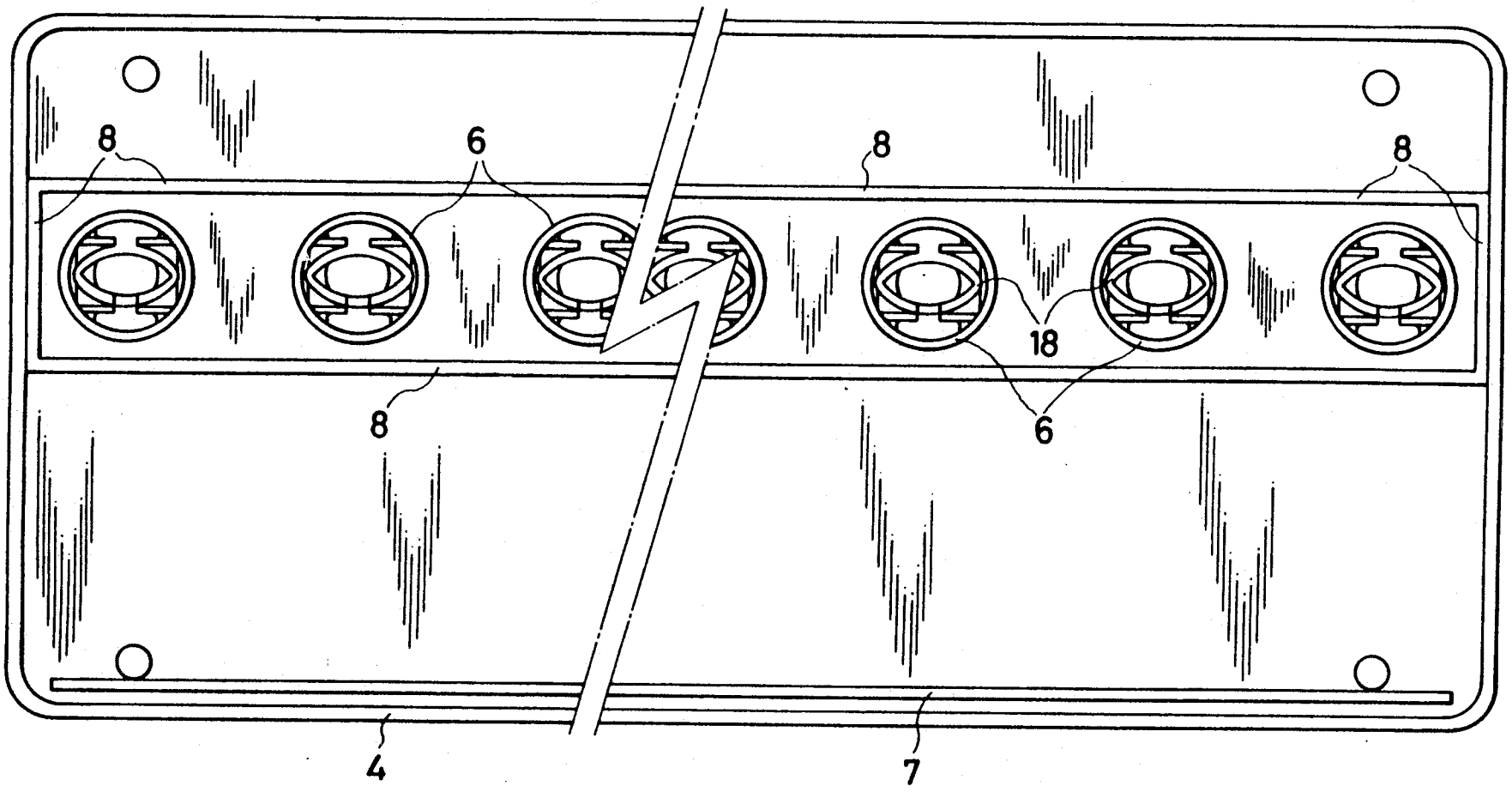
FIG. 4 is a bottom view of the wax applicator, particularly illustrating the arrangement of a series of outflow holes on a base of the wax applicator.

FIG. 1 is a front view of a wax applicator in accordance with an embodiment of the present invention, FIG. 2 is a side view of the wax applicator in FIG. 1, FIG. 3 is an enlarged fragmentary sectional view of the wax applicator taken in line III—III' in FIG. 1, and FIG. 4 is a bottom view of the wax applicator, particularly illustrating a base of the wax applicator as seen from below.

As shown in FIG. 1 to FIG. 4, the wax applicator A comprises a hollow rod-shaped grip handle 1, a base 4 disposed at the foremost end of the grip handle 1 via a swivel joint 3 while including a cloth 9 for wiping a floor surface B, a container holder 10 disposed at the intermediate part of the grip handle 1, a wax container to be described later (see FIG. 5) located in the container holder 10, a wax flow passage system extending from the wax container to outflow holes 6 on a base 4 and a wax feeding mechanism for opening and closing the outflow holes 6 by actuating a trigger lever with an operator's finger.

Referring to FIG. 1 and FIG. 2, the grip handle 1 is made of an aluminum pipe, and a grip 2 is fixedly secured to the uppermost end of the grip handle 1, while the base 4 is operatively connected to the foremost end of the grip handle 1 via the swivel joint 3. The base 4 is molded of an acrylonitrile butadiene styrene resin (hereinafter referred to as an ABS resin) and exhibits a trapezoidal configuration as seen from the side (see FIG. 3). In addition, the base 4 includes four binding holders 5 for holding the cloth 9 along the edge thereof, two of them being arranged on the inclined part on the front side and the other ones being arranged on the inclined part on the rear side of the base 4.

Referring to FIG. 3 and FIG. 4, the base 4 includes a base bottom plate 7 molded of an ABS resin and a plurality of circular outflow holes 6 are formed on the base bottom plate 7. As is best seen in FIG. 4, the outflow holes 6 are arranged in a row in the equally spaced relationship in the longitudinal direction of the base bottom plate 7. Two parallel ribs 8 extending in the transverse direction and another two ribs 8 extending in the forward/rearward direction of the base 4 are projected outwardly of the base bottom plate 7 around the outflow holes 6. With projection of these ribs 8 as mentioned above, since the cloth 9 tightly expanded over the base 4 is forcibly brought in close contact with a floor surface while exhibiting the substantially rectangular configuration, the cloth 9 makes it possible to uniformly coat the floor surface with a thin film of wax with the same functional effect where the floor surface is wiped with a floorcloth which has been tightly squeezed with operator's hands. In addition, each of the two ribs 8 extending in the transverse direction and the two ribs 8 extending in the forward/rearward direction of the base 4 serves to prevent an excessive amount of wax from oozing not only in the forward/rearward direction but also in the transverse direction of the cloth 9.

The wax flow passage system is composed of a liquid medium container 13 located in the container holder 10, an adjusting valve 15*b*, a distributing chamber 17 communicated with a flexible hose 16 to horizontally extend in the base 4 and liquid medium flow passages communicated with a plurality of tube nozzles 18.

Figure 5:
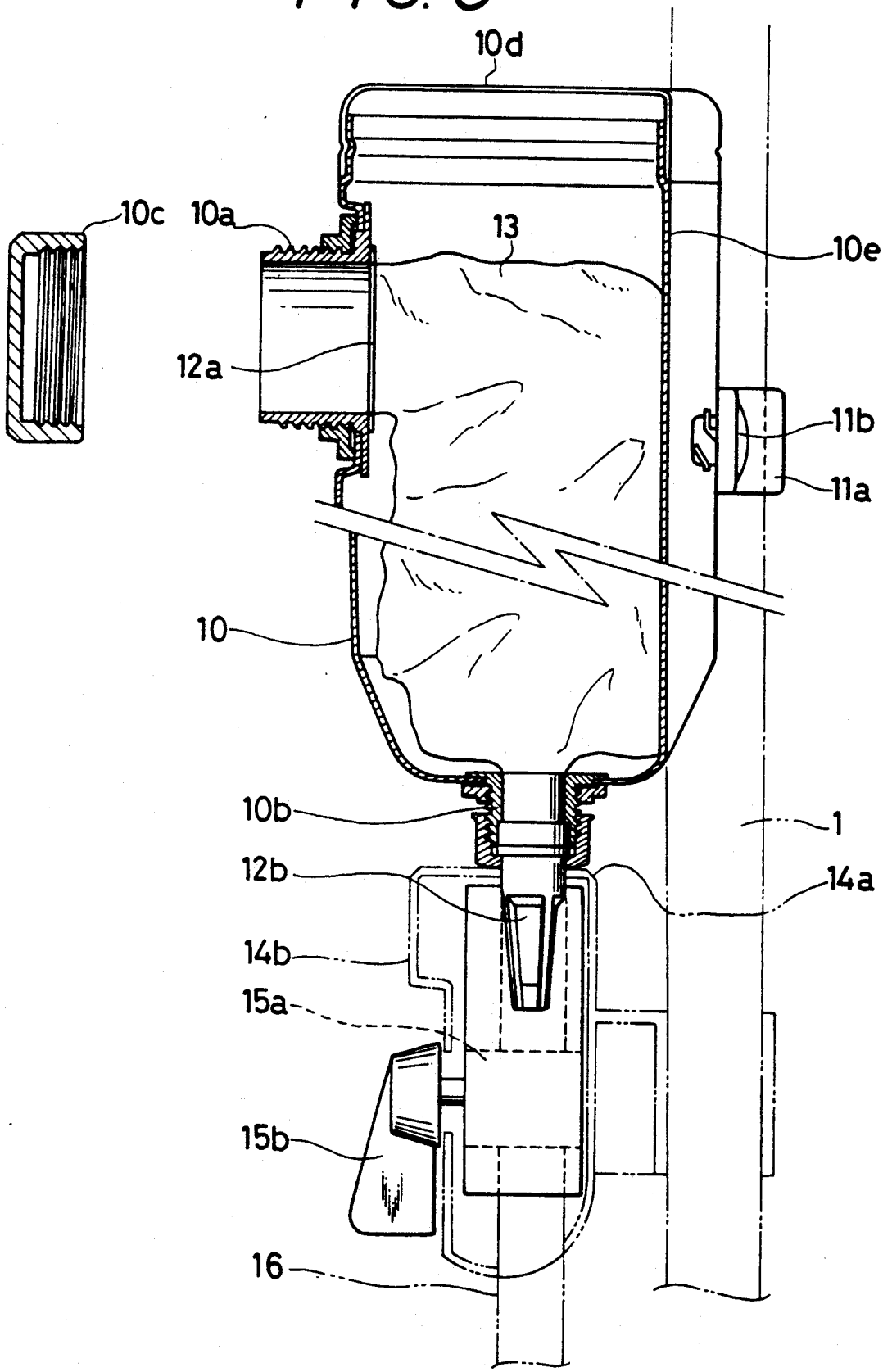
FIG. 5 is a partially exploded side view of a wax container located in a container holder firmly mounted on a rod-shaped grip handle.

FIG. 5 is a partially exploded sectional side view of the container holder 10. The container holder 10 is molded of a hard polyethylene in a hollow column-shaped configuration having a square cross-sectional shape, and a wax inlet hole 10*a* is formed on the front surface of the container holder 10 so as to allow a wax to be introduced into the interior of the liquid medium container 13. In addition, an outlet port 10*b* is formed on the tapered bottom part of the container holder 10 so as to allow a wax to flow to the base 4 side. A cap 10*c* can threadably be engaged with a male threaded part of a tube-shaped projection extending from the outlet port 10*b*. An opening having a large inner diameter is formed at the upper end of the container holder 10 so that a wax container 13 to be described later is received in the container holder 10, and a holder cap 10*d* is detachably fitted onto the opening of the container holder 10. It should be added that a small gap is formed between the holder cap 10*d* and the opening of the container holder 10 so as to permit air in the container holder 10 to flow out or flow in through the gap. An arc-shaped recess 10*e* of which vertically extending configuration coincides with that of the outer surface of the grip handle 1 is formed on the rear surface of the container holder 10. To support the container holder 10 on the grip handle 1, four female-threaded holes are formed on fixing pieces 11*a* at four corners of the container holder 10 so as to allow set screws 11*b* to be threadably fitted into the female-threaded holes through the fixing pieces 11*a*.

A filter 12*a* is attached to the inlet port 10*a* of the container holder 10 and another filter 12*b* is attached to the outlet port 10*b* of the same. The wax container 13 molded of a soft polyethylene has two openings, and one of the openings is connected to the inlet port 10*a* of the container holder 10 while the other one is connected to the outlet port 10*b* of the same so that a liquid wax is stored in the wax container 13 which is located in the container holder 10. To ensure that the wax container 13 has a sufficiently high strength while exhibiting excellent flexibility, the wax container 13 is constructed using a double-walled structure. The filter 12*a* attached to the inlet port 10*a* of the substance from being introduced into the interior of the wax container 13 and the filter 12*b* attached to the outlet port 10*b* of the container holder 10 additionally prevents impurities or the like in the supplied wax from flowing to the base 4 side. Since air freely flows in the container holder 10 and flows out therefrom but the wax container 13 is held in the hermetic state, the wax container 13 contracts as the liquid wax flows out from the wax container 13 and air in the wax container is evacuated. Thus, the liquid wax will easily flow out from the wax container 13. Additionally, since the liquid wax is not exposed to the air with the exception of the time when it is injected into the wax container 13, the liquid wax is not dried and solidified in the interior of the wax container 13.

As is best seen in FIG. 5, a valve cover 14*b* is secured to the outlet port 10*b* side of the container holder 10 via a valve holder 10*b* attached to the grip handle 1, and the filter 12*b* is located in the valve cover 14*b*. In addition, an adjusting valve 15*a* for adjustably opening or closing the wax flow passage is received in the valve cover 14*b* below the filter 12*b*. To actuate the adjusting valve 15*a*, a knob 15*b* is attached to a stem of the adjusting valve 15*a* outside of the valve cover 14*b*.

The upper end of the flexible hose 16 is connected to the adjusting valve 15*a*, while the lower end of the same is connected to the distributing chamber 17 in the base 4. It should be noted that the flexible hose 16 is curved and extends by a sufficiently long length outside of the grip handle 1 so that it does not cause any trouble when the grip handle 1 is held in the tilted state.

Figure 6:
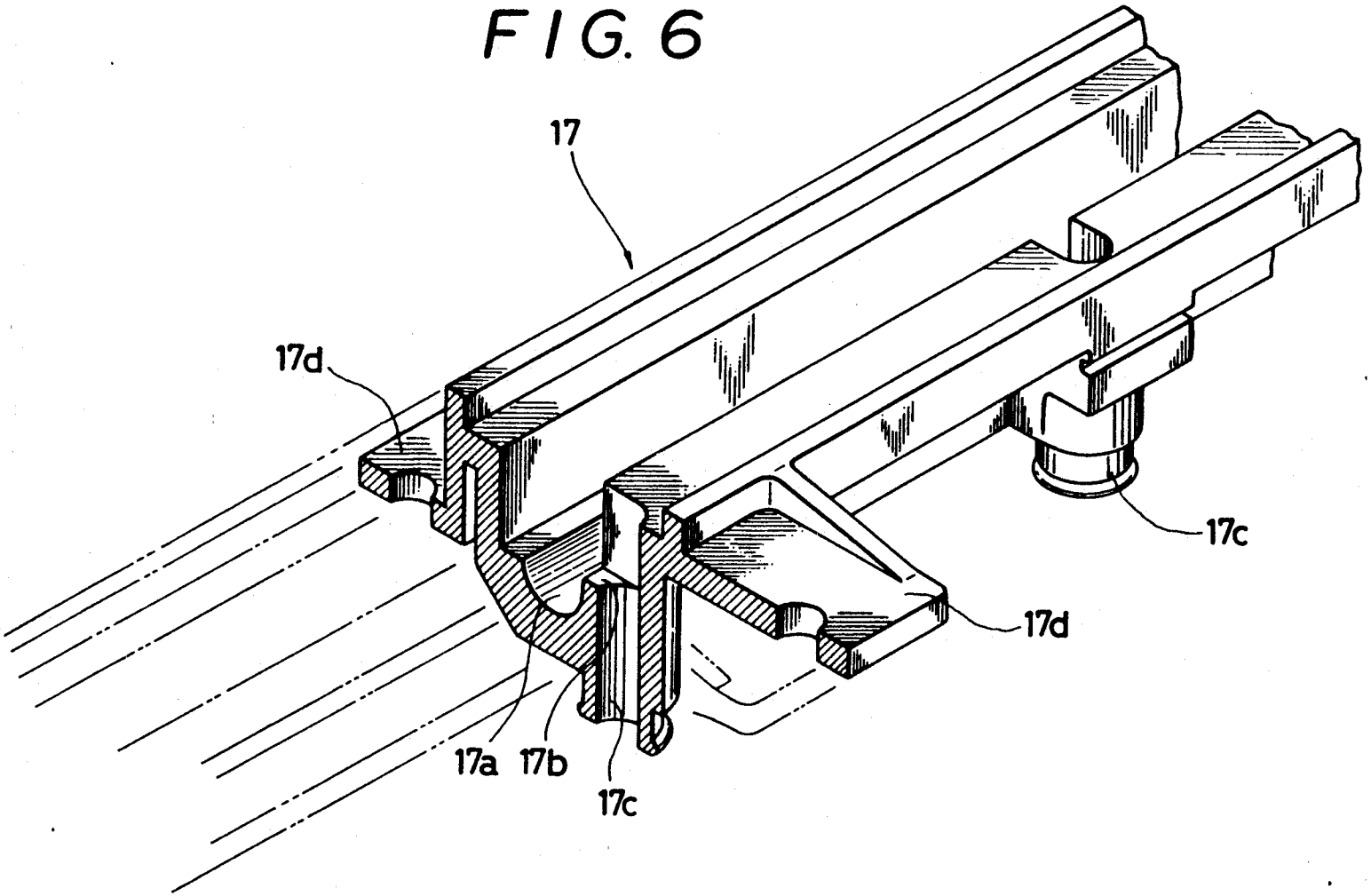
FIG. 6 is a partially exploded perspective view of a distributing chamber in the base.

FIG. 6 is a fragmentary perspective view of the distributing chamber 17. The distributing chamber 17 having a long length is molded of an ABS resin, and a longitudinally extending wax storing portion 17*a* in the form of a groove having an arc-shaped cross-sectional shape is formed at the bottom of the distributing chamber 17. A communication passage 17*b* is formed on one side wall of the wax storing portion 17*a* by cutting out a part of the side wall from the top end down to the lower part thereof. In addition, a discharge passage 17*c* is formed on the one side wall while extending downward from the communication passage 17*b*. A plurality of assemblies each comprising the communication passage 17*b* and the discharge passage 17*c* are arranged in an equidistant relationship in the longitudinal direction of the distributing chamber 17 so that the liquid wax overflowing from the wax storing portion 17*a* is uniformly distributed through all the discharge passages 17*c*.

An annular projection is formed at the lower end of each discharge passage 17*c* in order to prevent disconnection of a tube nozzle 18 (see FIG. 8) from the discharge passage 17*c*. The distributing chamber 17 is provided with four sets of fitting portions 17*d* outside of the opposite side walls thereof so that it is secured to the base 4 by tightening set screws inserted through the respective fitting portions 17*d* so the longitudinal direction of the distributing chamber 17 coincides with the transverse direction of the base 4. It should be noted that two sets of the fitting portions 17*d* outside of one side wall of the distributing chamber 17 are not aligned with the other two sets of the fitting portions 17*d* outside of the other side wall in respect of a height.

As shown in FIG. 3, the lower end of the flexible hose 16 is opened to a distributing chamber 17 at a position where no interference takes place between the flexible hose 16 and the discharge passage 17*c*. Thus, after the liquid wax flows in the wax storing portion 17*a*, the liquid wax uniformly overflows through all the discharge passages 17*c* when the surface level of the liquid wax is raised up above the communication passages 17*c*.

Figure 7:
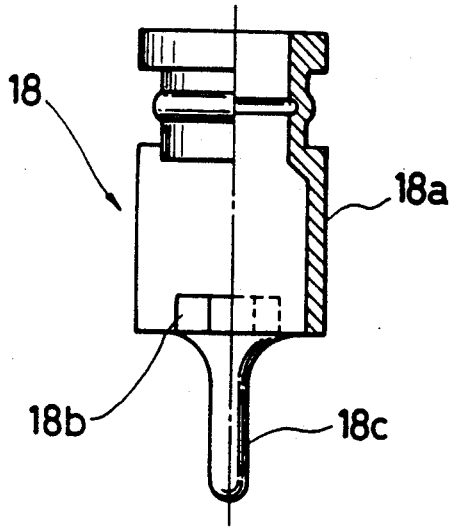
FIG. 7 is a front view of a tube nozzle.

Referring to FIG. 7, the tube nozzle 18 is molded of a silicone rubber which is not adhered to by the liquid wax.

Figure 8:
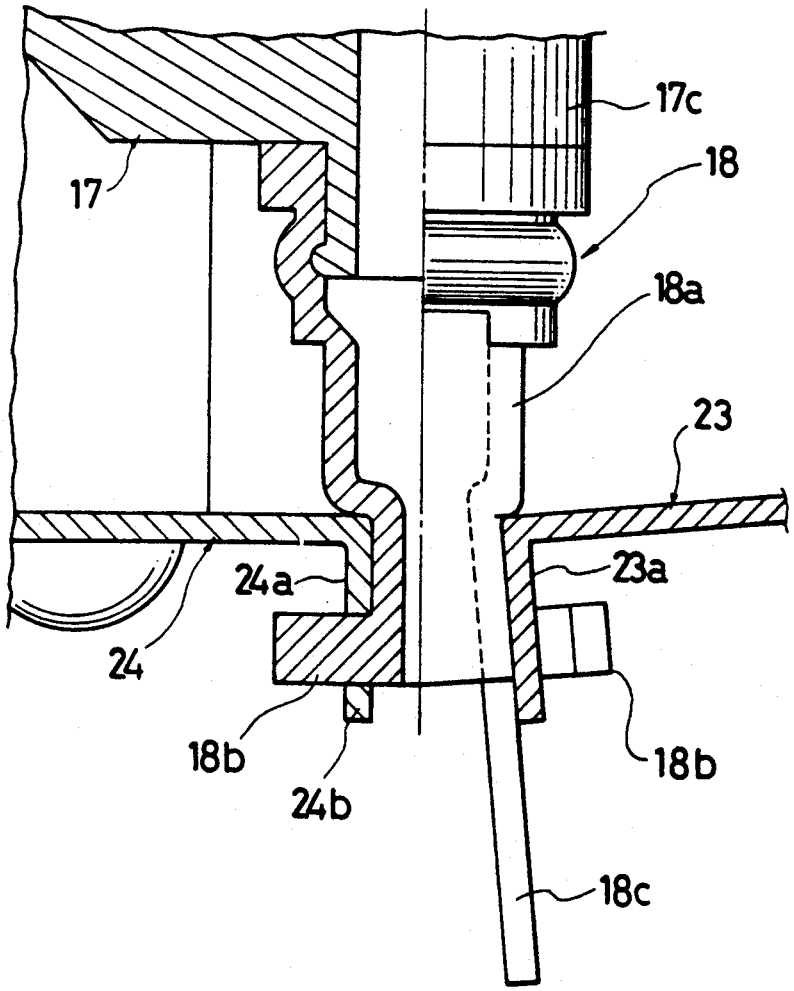
FIG. 8 is a partially exploded side view of the tube nozzle, particularly illustrating that the tube nozzle is held in a clamped state between a stationary pressure plate and a movable pressure plate.

FIG. 7 is a front view of the tube nozzle 18 of which right-hand half is sectioned along a center axis and FIG. 8 is a partially sectioned side view of the tube nozzle 18, particularly illustrating that the tube nozzle 18 is fitted onto the annular projection of the discharge passage 17*c*. As is apparent from FIG. 8, the upper end of the tube nozzle 18 is press fitted onto the annular projection of the discharge passage 17*c* extending from the distributing chamber 17 and includes a straight body portion 18*a* having a predetermined length below the discharge passage 17*c*. In addition, an inverted T-shaped engagement piece 16 is projected downward of the body portion 18*a* to allow pressure plates 23 and 24 to be described later to be engaged with the engagement piece 18*b*. The body portion 18*a* is squeezed between the pressure plates 23 and 24. Specifically, the body portion 18*a* is deformed by forcibly holding it between the both pressure plates 23 and 24 in the clamped state during outflow of the liquid wax, until the flow passage in the body portion 18*a* is completely closed. On the contrary, when the pressure plates 23 and 24 are parted away from each other, the tube nozzle 18 is restored to the original opened state by virtue of an elasticity of the tube nozzle 18.

To facilitate dripping of the remaining liquid wax, the tube nozzle 18 is provided with a tongue-shaped projection 18*c* which extends downward from the lower end of the tube nozzle 18. The region where the base end of the tongue-shaped projection 18*c* merges with the lower end of the body portion 18*a* of the tube nozzle 18 exhibits an arc-shaped contour to allow the liquid wax to drip along the tongue-shaped projection 18*a*. Further, the lower end of the tongue-shaped projection 18*c* is rounded to additionally facilitate dripping of the liquid wax. The tongue-shaped projection 18*c* is projected further downward from the ribs 8 on the base bottom plate 7. According to the embodiment of the present invention, the tongue-shaped projection 18*c* is dimensioned to have a length which allows the cloth 9 to be downwardly bent due to contact with the foremost end of the tongue-shaped projection 18*c*. This enables drops of the liquid wax to move to the cloth 9. It should be noted that the length of the tongue-shaped projection 18*c* should not be limited only to the above length but it may be determined arbitrarily. For example, it may be dimensioned to be shorter than the height of each of the ribs 8.

A wax feeding mechanism for opening or closing the outflow holes 6 with an operator's hand will be described below. As shown in FIG. 1 and FIG. 2, the wax feeding mechanism is composed of a trigger lever 20 attached to the uppermost end of the grip handle 1, a wire rope 21 operatively connected to the trigger lever 20 and pressure plates 23 and 24 disposed in the base 4 to open or close the tube nozzles 18 via the wire rope 21 by actuating the trigger lever 20 with an operator's finger.

The trigger lever 20 is turnably supported to turn about a pivotal pin (not shown) in the grip 2 of the grip holder 1 so that it is normally protruded outside of the grip 2 by a spring (not shown) received in the grip 2. On the other hand, the upper end of the wire rope 21 is operatively connected to the trigger lever 20 at a predetermined position located in the grip 2, and the wire rope 21 extends outside of the grip handle 1 at the position above the universal joint 3. The lower end of the wire rope 21 is operatively connected to the movable pressure plate 23 in the base 4. When the trigger lever 20 is depressed with an operator's finger against the resilient force of the spring while the grip handle 1 is held by the operator's other hand, the wire rope 21 is pulled up to displace the movable pressure plate 23. When the trigger lever 20 is released from the depressed state, the wire rope 21 is restored to the original position where the movable pressure plate 23 is held in a closed state. In FIG. 3, reference numeral 22 designates a wire rope protection tube molded of a polyvinyl chloride.

Figure 9:
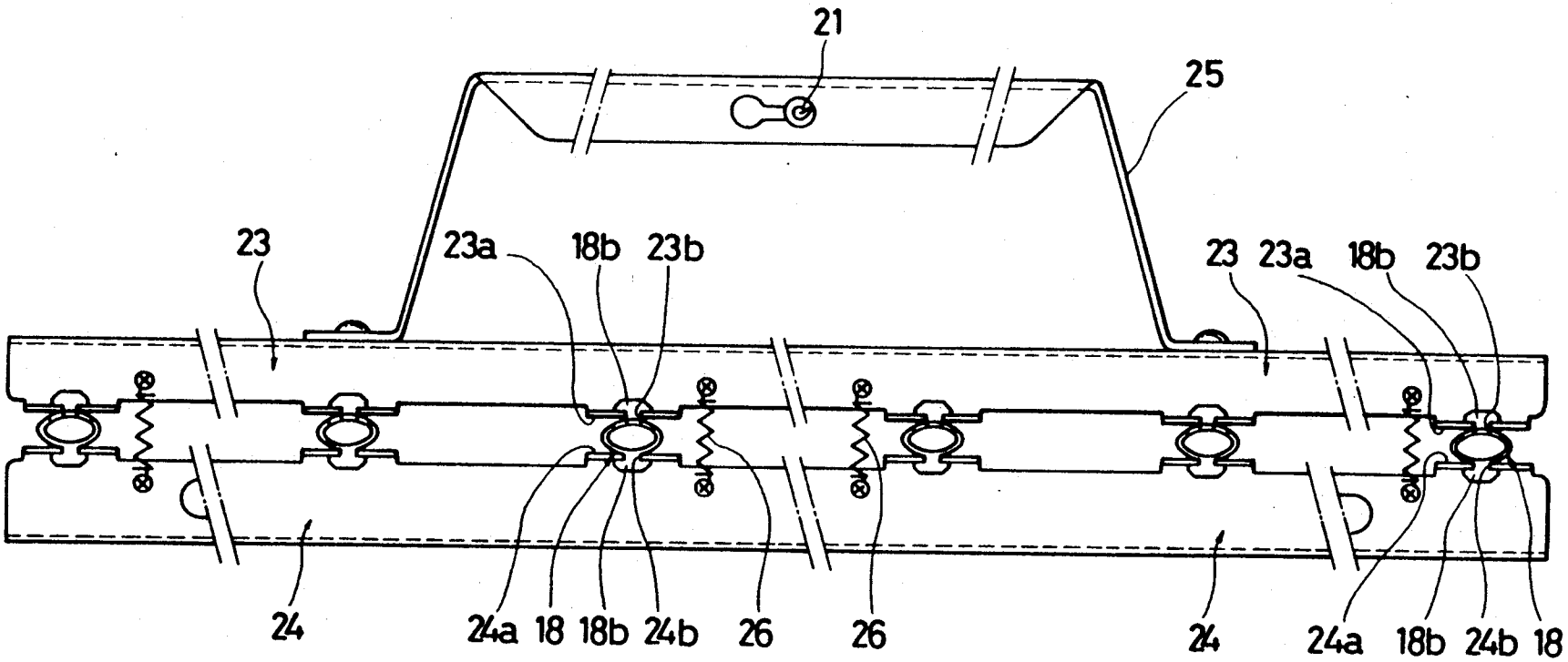
FIG. 9 is a bottom view of the base, particularly illustrating that a series of tube nozzles are held in a clamped position between the stationary pressure plate and the movable pressure plate.
Figure 10:
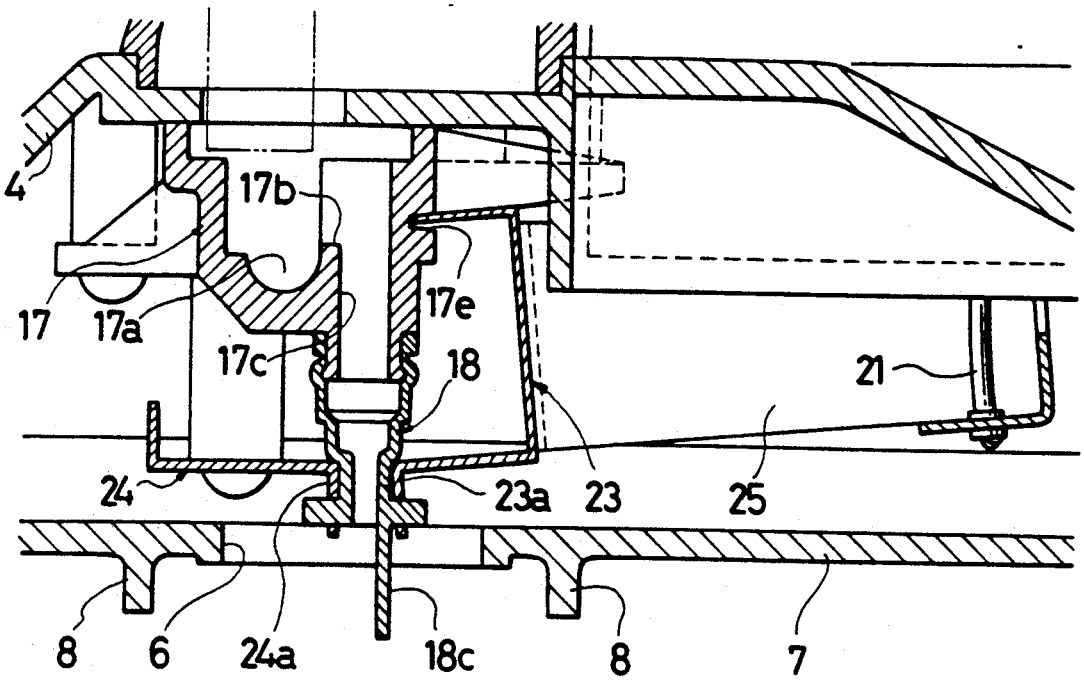
FIG. 10(*a*) and FIG. 10(*b*) are illustrative views which show actuation of the movable pressure plate.
Figure 10:
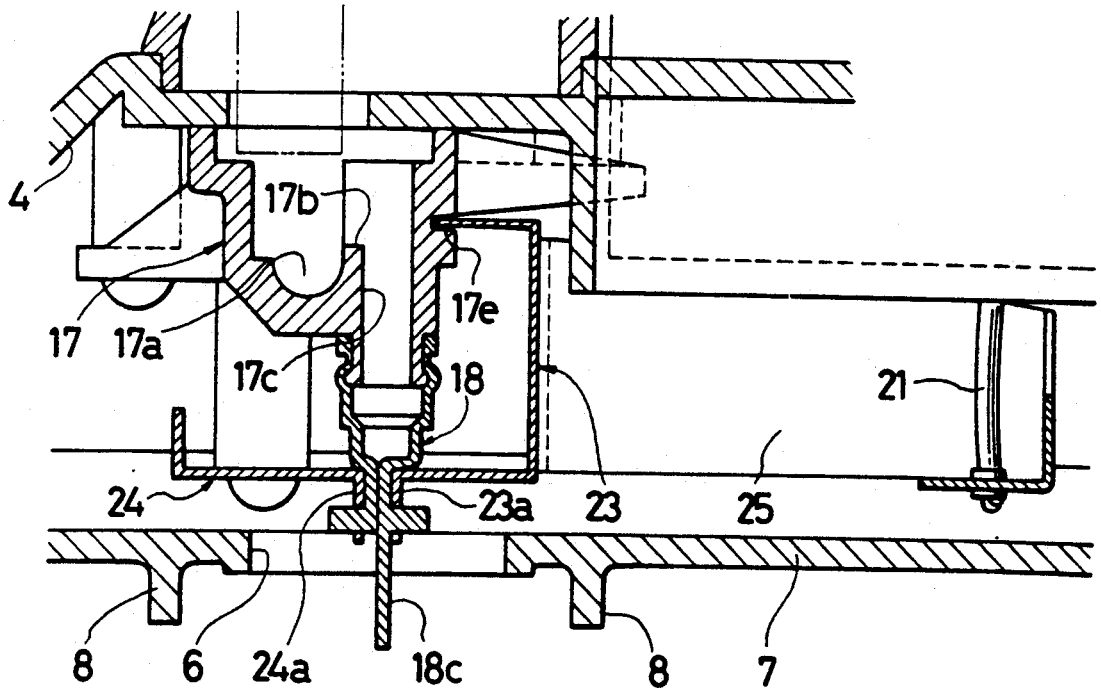

As shown in FIG. 9, FIG. 10(*a*) and FIG. 10(*b*), an assembly of movable pressure plate 23 and stationary pressure plate 24 is arranged in the base 4. FIG. 9 is a bottom view which illustrates that the both pressure plates 23 and 24 are operatively engaged with the tube nozzles 18. FIG. 10(*a*) is a fragmentary sectional view of the base 4 which illustrates that the tube nozzle 18 is opened while the movable pressure plate 23 is turnably displaced via the wire rope 21 by actuating the trigger lever 20 with an operator's finger, and FIG. 10(*b*) is a fragmentary sectional view which illustrates that the tube nozzle 18 is closed by the pressure plate 23 in cooperation with the stationary pressure plate 24.

Each of the pressure plates 23 and 24 is made of a plate of stainless steel by bending it, and the same number of squeezing portions 23*a* and 24*a* as that of the tube nozzles 18 are formed in the equidistant relationship in the longitudinal direction of the pressure plates 23 and 24 by bending them at a right angle in a downward direction. The stationary pressure plate 24 is fixedly secured to the base 4 by tightening set screws inserted through holes on the horizontal portion thereof. In addition, an arm plate 25 having an U-shaped contour as seen in a plan view is fixedly secured to the vertical side wall of the movable pressure plate 23, and the foremost end of an upper horizontal portion of the movable pressure plate 23 is fitted into a horizontally extending cutout 17*e* on the distributing chamber 17. Further, a plurality of return springs 26 are arranged between squeezing portions 23*a* and 24*a* to normally bias them in such a direction that they approach each other.

With such construction, as shown in FIG. 10(*a*), when the wire rope 21 is pulled up by depressing the trigger lever 20 with an operator's finger, the arm plate 25 fixedly secured to the movable pressure plate 23 is turnably raised up against the resilient force of the return springs 26 to turn about the foremost end of the upper horizontal portion thereof which coincides with the cutout 17*e*. As shown in FIG. 10(*b*), when the wire rope 21 is released from the pulled-up state, the movable pressure plate 23 is restored to the original position where the tube nozzles 18 are closed in the clamped state by the resilient force of the return springs 26. Vertically extending slots 23*b* and 24*b* are formed at the lower parts of the squeezing portions 23*a* and 24*a* of the pressure plates 23 and 24 so that engagement pieces 18*b* of each tube nozzle 18 are inserted into the slots 23*b* and 24*b* to hold the tube nozzle 18 in the clamped state between the both pressure plates 23 and 24. As shown in FIG. 8, to assure that the body portion 18*a* of the tube nozzle 18 is adequately held in the clamped state between pressure plates 23 and 24, the squeezing portion 24*a* of the stationary pressure plate 24 is immovably held in the squeezed state so that the inner wall of the body portion 18*a* is located near the center axis of the tube nozzle 18. On the other hand, when the movable pressure plate 23 is fully displaced to assume an opened state, the body portion 18*a* of the tube nozzle 18 is slightly squeezed while coming in contact with the squeezing portion 23*a* of the movable pressure plate 23.

Alternatively, a single support shaft (not shown) extending in parallel with a series of the discharge passages 17*c* in the transverse direction of the applicator A may be substituted for the horizontally extending cutout 17*e*. In this case, the support shaft is operatively connected to the movable pressure plate 23 via some suitable means so that it serves as a fulcrum the turning movement of the movable pressure plate 23. When the wire rope 21 is pulled up by depressing the trigger lever 20 with an operator's finger, the outer end of the movable pressure plate 23 is turnably raised up to open the tube nozzles 18, whereby the liquid wax flows out through the respective tube nozzles 18. Subsequently, when the wire rope 21 is released from the pulled-up state, the movable pressure plate 23 is restored to the original position where the tube nozzles 18 are in the closed state by the resilient force of the return springs 26. With this construction, there is no need of performing a machining operation for forming the cutout 17*e*, and moreover, there is no possibility that the movable pressure plate 23 is disconnected from the cutout 17*e*.

Further, integral clamping means may be substituted for an assembly of the movable pressure plate and the stationary pressure plate so that the respective tube nozzles 18 are clamped from sides by the integral clamping means by depressing the trigger lever 20 with an operator's finger.

According to the aforementioned embodiment of the present invention, the wax container 13 is attached to the grip handle 12 via the container holder 10. Alternatively, the wax container 13 may be mounted directly on the base 4.

Next, operation of the wax applicator A as constructed in the above-described manner will be described below.

When a wax applying operation is performed, the knob 15*b* for the adjusting valve 15*a* is first actuated with an operator's hand to allow the wax container 13 to be communicated with the respective tube nozzles 18. Then, when the trigger lever 20 is depressed with an operator's finger while the grip handle 1 is held by the operator's other hand, the movable pressure plate 23 which has maintained the tube nozzles 18 in the clamped state to close them is turnably displaced away from the stationary pressure plate 24 via the wire rope 21, whereby the tube nozzles 18 are opened and the liquid wax flows out through the outflow holes 6 on the base bottom plate 7 (to assume the operative state as shown in FIG. 10(*a*)). When the liquid wax permeates through the cloth 9, an operator is ready to start a wax applying operation. In practice, a wax applying operation is performed by repeatedly displacing the base 4 in the forward/rearward direction with the grip handle 1 held with an operator's hand while adequately actuating the trigger lever 20 based on visual determination of spreading of the liquid wax on the floor surface. When it is required that outflow of the liquid wax is stopped, the trigger lever 20 is released from the depressed state, causing the wire rope 21 to be restored to the original position, whereby the movable pressure plate 23 is turnably returned by the resilient force of the return springs 26 to close the respective tube nozzles 18 in the clamped state.

Therefore, since a wax applying operation is performed while adequately adjusting a flow rate of the liquid wax by actuating the trigger lever 20 with an operator's finger, there is no need of performing such a complicated operation such as adjusting an extent of opening/closing of the adjusting valve 15*a* via the knob 15*b* with an operator bent forward every time when a wax applying operation is performed.

The liquid wax flows out through the respective tube nozzles 18 only when the trigger lever 20 is depressed with an operator's finger but the liquid wax does not flow out at all when the trigger lever 20 is released from the depressed state, so that the liquid wax does not continue to flow through the tube nozzles 18 and coat the floor with a thick film of liquid wax, as is often the case when an operator carelessly leaves his working site In addition, since each tube nozzle 18 is closed in the clamped state in cooperation of the movable pressure plate 23 with the stationary pressure plate 24 and drops of the liquid wax successively fall down from the lowermost end of the tongue-shaped projection 18*c* extending downward from the lower end of the tube nozzle 18, there is no possibility that the liquid wax is solidified during a wax applying operation. Further, since the liquid wax is hermetically received in a bag-shaped container molded of a soft thermoplastic synthetic resin, there is no possibility that the liquid wax is exposed to air that would cause it to solidify.

Additionally, since the liquid wax uniformly flows into the discharge passages 17*c* from the distributing chamber 17, it uniformly permeates through the cloth 9 which has been tightly expanded by the ribs 8 on the base bottom plate 7, resulting in an uniform wax applying operation being performed with the same functional effect as where the floor surface is wiped using a tightly squeezed floorcloth.

Figure 11:
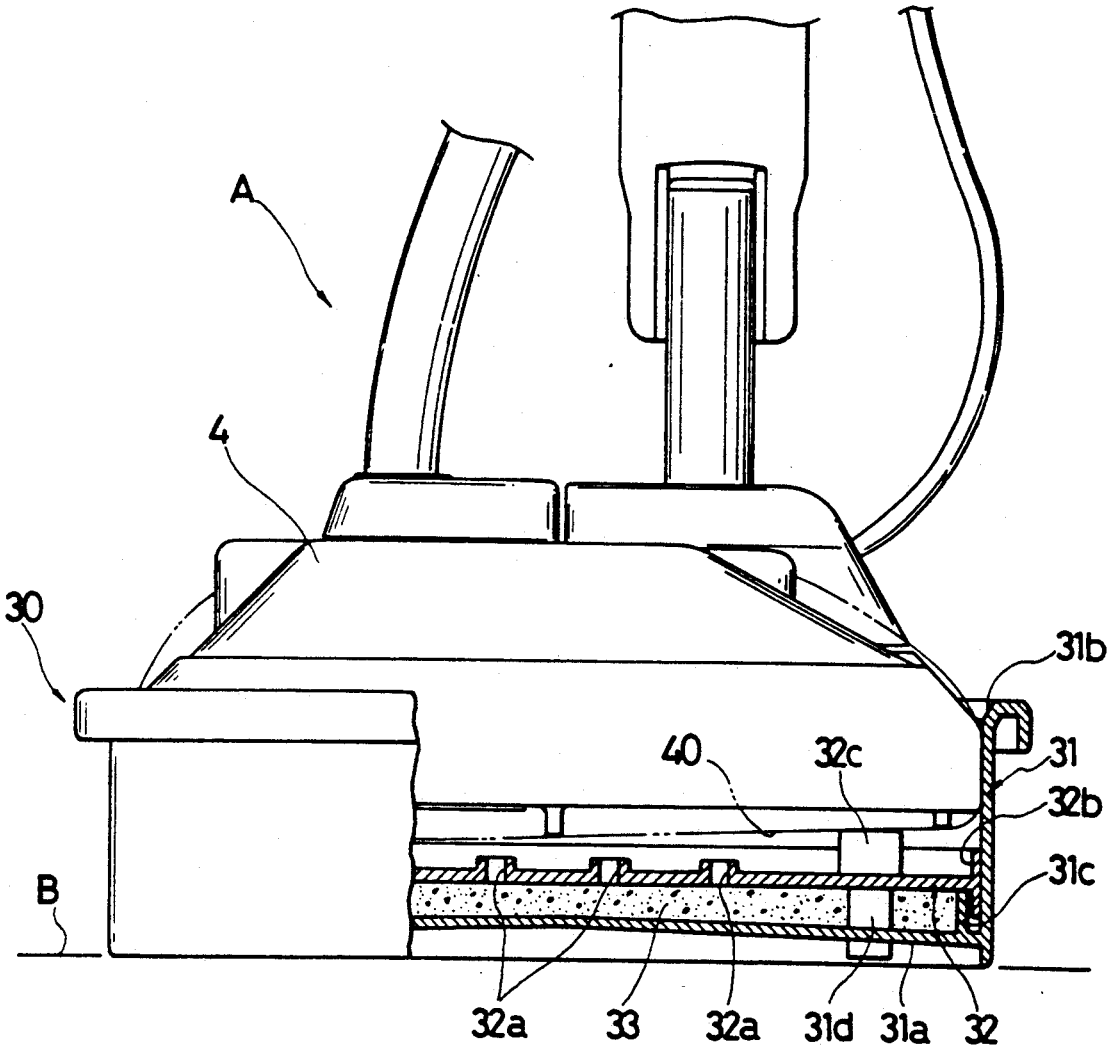
FIG. 11 is a partially exploded side view of a tray for moistening the wax applicator in accordance with an embodiment of the present invention, particularly illustrating that the base of the wax applicator is placed on the tray.

Next, a tray for moistening the wax medium applicator will be described below with reference to FIG. 11. FIG. 11 is a partially exploded side view of the tray in accordance with another embodiment of the present invention, particularly illustrating that the wax applicator is placed on the tray.

The tray 30 is molded of an ABS resin. Specifically, the tray 30 is composed of a housing 31 having an opening of a diameter dimensioned to receive the base 4 of the wax applicator A from above, a tray bottom plate 32 spaced away from a bottom 31*a* of the housing 31 to hold the base 4 thereon with a number of ventilation holes 32*a* formed on the tray bottom plate 32, and a mass of fibers 33 having excellent water absorptivity located between the bottom 31*a* of the housing 31 and the tray bottom plate 32 and sufficiently impregnated with water.

The housing 31 is molded in the substantially rectangular configuration as seen in the transverse direction in a plan view such that the base 4 having the cloth 9 tightly expanded thereon is snugly received in the housing 31. In addition, the housing 31 includes ribs 31*c* at four corners of the bottom 31*a* with a predetermined gap between the ribs 31*c* and the inner wall surface of the housing 31 to support the tray bottom plate 32 of the tray 30 on the bottom 31*a* of the housing 30. Further, several fitting portions 31*d* are arranged on the bottom 31*a* of the housing 31 to immovably hold the tray bottom plate 32.

The mass of fibers 33 in the form of a water absorptive sheet impregnated with water is located in the space between the tray bottom plate 32 and the bottom 31*a* of the housing 31*a* so that water is vaporized from the mass of fibers 33 through the ventilation holes 32*a*.

On the other hand, the bottom plate 32 of the tray 30 has a contour which is dimensioned so the tray bottom plate 32 is exactly fitted into the housing 31 while a peripheral rib 32*b* of the tray bottom plate 32 is located between the ribs 31*c* and the inner wall surface of the housing 31*a*. While the foregoing state is maintained, the tray bottom plate 32 is fixedly held from above by tightening fixtures (not shown) on fitting portions 32*c* which are correctly aligned with the fitting portions 31*d* on the bottom 31*a* of the housing 31. The upper open end of each ventilation hole 32*a* is elevated from the upper surface of the tray bottom plate 32 so as not to allow drops of the liquid wax which have fallen down from the cloth 9 on the tray bottom plate 32 to enter the interior of the housing 31 of the tray 30. Moisture vaporized from the mass of fibers 33 flow up through the ventilation holes 32*a*. Thus, the cloth 9 tightly expanded over the base 4 placed on the tray bottom plate 32 is always maintained in a moistened state.

The tray 30 for moistening the wax applicator A as constructed in the above-described manner is used when a wax applying operation is completed or it is interrupted for some reason. Specifically, when the wax applicator A including the cloth 9 impregnated with the liquid wax is placed on the tray 30, moisture or steam vaporized from the mass of fibers 33 through the ventilation holes 32*a* on the tray bottom plate 32 always flows while coming in contact with the cloth 9 and the tube nozzles 18. Thus, the cloth 30 is always maintained in the moistened state even after it is left still for a long period of time. As a result, the cloth 9 is not dried at all, and thereby solidification of the liquid wax can be prevented. When a wax coating operation is to be interrupted, it suffices that the wax applicator A is placed on the tray 30 which is located at an arbitrary position near an operator. Thus, the wax applicator A can conveniently be used at all times and a wax applying operation can quickly be started again.

Figure 12:
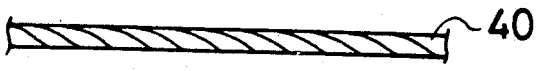
FIG. 12(*a*) to FIG. 12(*c*) are illustrative views which show threads each composed of very fine synthetic fibers which are subjected to shrinking and curling to allow the threads to be woven to a cloth for the wax applicator.
Figure 12:
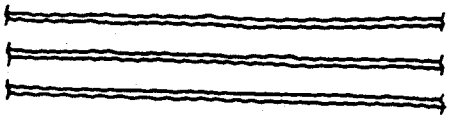
Figure 12:
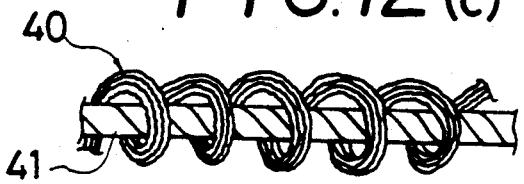

Next, a cloth employable for the wax applicator A will be described below with reference to FIG. 12 and FIG. 13. FIGS. 12(*a*) to 12(*c*) are illustrative views which show threads for a cloth employable for the wax applicator A in accordance with another embodiment of the present invention, wherein very fine synthetic fibers are shrunk and curled to allow them to be used as a raw material for each thread.

Several very fine synthetic fibers 40 shown in FIG. 12(*a*) are twisted together after they are subjected to shrinking and curling as shown in FIG. 12(*b*). Subsequently, as shown in FIG. 12(*c*), the several intertwisted very fine synthetic fibers 40 are spirally wound around a single core thread 41 (composed of very fine synthetic fibers) which is not subjected to shrinking and curling (to form a sheath thread). A cloth employable for the wax applicator A is produced by weaving the threads which have been prepared in the above-described manner.

Figure 13:
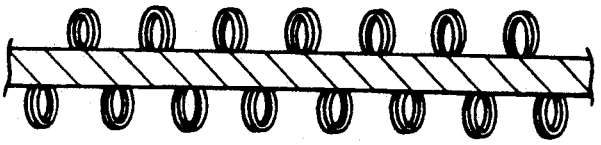
FIG. 13 is an illustrative view which shows a thread composed of very fine synthetic fibers for making a cloth for the wax applicator having a towel-shaped structure.

FIG. 13 is an illustrative sectional view which shows a thread for a cloth employable for the wax applicator in accordance with further another embodiment of the present invention. In this embodiment, to produce a cloth employable for the wax applicator, threads each composed of several very fine synthetic fibers which are subjected to reforming, e.g., by processing them for adding a hydrophilic group to them thereby to improve a property of water absorptivity, are used. These threads are woven to a cloth which exhibits a towel-shaped appearance.

The cloth which has been woven in the above-described manner is very durable. With this cloth, a wax applying operation can be performed easier and more uniformly than in a case where threads each composed of cotton fibers are used.

Although no drawing is shown in the specification, the utility of the cloth employable for the wax applicator can be improved further by lining the rear surface of the cloth with an unwoven cloth having an excellent property of water retention.

While the present invention has been described above as to a case where a wax is used as a liquid medium for the liquid medium applicator, it should be noted that the present invention should not be limited only to the wax. Alternatively, the present invention may equally be applied to a paint, a wax separating agent, a floor oil, a floor sterilizing agent or the like.

As will be apparent from the above description, the present invention offers the following advantageous effects.

According to the present invention, the liquid medium applicator is constructed such that each tube nozzle in each outflow hole on the base can be opened or closed in the clamped state by actuating the fluid medium feeding mechanism with an operator's finger while the grip handle is held by the operator's other hand. Thus, there is no possibility that air is undesirably introduced into the fluid medium flow passage through the outflow holes when the liquid medium applicator is not in use. In addition, since the liquid medium container is molded of a soft thermoplastic synthetic resin in the form of a hollow hermetic container and thereby the container itself contracts when the interior of the liquid medium container is increasingly evacuated as the fluid medium flows out therefrom, nothing prevents drops of the liquid medium from falling down without any necessity for forming air ventilation holes on the liquid medium container. In a case where a liquid wax is practically used as a liquid medium, since the whole flow passage extending from an inlet port to an outlet port thereof is kept in the completely hermetic state, steam derived from vaporization of water contained in the hot wax is filled in the interior of the container having a limited space within a short period of time to immediately reach a saturated steam pressure while preventing further vaporization of water with the result that solidification of the wax does not take place in the container. Further, arrangement of tongue-shaped projections extending downward from the respective tube nozzles assures that the remaining liquid wax falls down in the form of drops from the lowermost ends of the respective tongue-shaped projections without solidification of the liquid wax. Thus, the liquid wax is not solidified during use of the applicator.

Since the liquid medium applicator is provided with a liquid feeding mechanism to open or close the flow passage by actuating the trigger lever with an operator's finger, a liquid medium applying operation can be performed at a high operational efficiency with more easily. In addition, since the respective tube nozzles are kept closed while the trigger lever is released from the depressed state, there is no possibility that the liquid medium will continue to flow out and excessively coat the floor surface with the liquid medium.

Further, since the base is provided with a distributing chamber including a plurality of discharge passages communicating with a respective tube nozzles at a position higher than the bottom of a liquid storing portion, the liquid medium which has been introduced into the distributing chamber uniformly overflows to the respective tube nozzles via the liquid medium storing portion and the discharge passage and then uniformly flows out through the tube nozzles. This makes it possible that the floor surface is uniformly coated with the liquid medium without any irregularly coated spot.

Arrangement of two ribs extending in the transverse direction and another two ribs extending in the forward/rearward direction of the base within the substantially rectangular region on the base permits a cloth to be tightly expanded over the base with the aid of these ribs. This assures that the floor surface is uniformly coated with a thin film of liquid medium as where the floor surface is wiped with a so-called tightly squeezed floorcloth. It should be added that these ribs serve to prevent an excessive quantity of liquid medium from permeating through the cloth not only in the forward-/rearward direction but also in the transverse direction of the base. Consequently, even an unskilled operator can perform a liquid medium applying operation for uniformly coating the floor surface with a thin film of liquid medium.

With the tray for moistening the liquid medium applicator in accordance with the present invention, while the base of the liquid medium applicator is placed on the bottom plate of the tray, steam is vaporized from water impregnated in a mass of water absorptive material and flows up through the ventilation holes on the tray bottom plate to reach the base of the liquid medium applicator through the cloth, whereby steam is filled in the space between the cloth and the base of the liquid medium applicator. This reliably prevents solidification of the liquid medium around the cloth and the tube nozzles. In addition, when a liquid applying operation is to be interrupted, the liquid medium applicator can temporarily be placed on the tray located at the position near to an operator. Thus, he can quickly start a liquid applying operation again. Consequently, the liquid medium applicator can be used very conveniently.

Further, with respect to the cloth employable for the liquid medium applicator, since the cloth is woven to form a towel-shaped structure while using a number of threads each composed of very fine synthetic fibers which have been subjected to shrinking and curling, a property of water retention can be raised up by improving a property of water absorption of the fiber structure. In addition, since the cloth has an excellent property of followability to ruggedness on the floor surface, a liquid medium applying operation can uniformly be performed with a thin film of liquid medium. Further, when the rear surface of the cloth is lined with an unwoven cloth or the like having an excellent property of water retention, a property of water retention of the cloth of the present invention can be improved substantially.

While the present invention has been described above with respect to typical preferred embodiments thereof, it should of course be understood that the present invention should not be limited only to these embodiments but various changes or modifications may be made without departure from the scope of the invention as defined by the appended claims.

What is claimed is:

1. In a liquid medium applicator including a base operatively connected to an end of a rod-shaped grip handle, a cloth tightly expanded over said base for applying a liquid medium to a floor surface, a liquid medium container mounted on said grip handle or said base and an opening/closing mechanism for opening or closing a liquid medium flow passage extending from said liquid medium container to outflow holes on said base, the improvement comprising:

a plurality of tube nozzles arranged in said outflow holes in said base, each of said tube nozzles being molded of a soft thermoplastic resin, and a liquid medium feeding mechanism operable by an operator's hand to open or close said tube nozzles.

2. The liquid medium applicator as claimed in claim 1, said liquid medium feeding mechanism comprising:

a trigger lever disposed at an upper end part of said grip handle to be depressed with an operator's finger; and a movable pressure plate operatively connected to said trigger lever via connecting means to open said tube nozzles when said trigger is in a depressed state and to close said tube nozzles when said trigger lever is released from said depressed state.

3. The liquid medium applicator as claimed in claim 1, each of said tube nozzles comprising:

a tongue-shaped projection extending from a terminal end of said tube nozzle to facilitate dripping of said liquid medium from each tube nozzle while preventing said liquid medium from adhering to said tube nozzle.

4. The liquid medium applicator as claimed in claim 1, wherein said liquid medium container is molded of a soft thermoplastic synthetic resin in a hollow hermetic container shape.

5. The liquid medium applicator as claimed in claim 1, said base comprising:

a distributing chamber having a plurality of discharge passages extending therefrom communicating with said tube nozzles.

6. The liquid medium applicator as claimed in claim 1, said base comprising:

two ribs extending in a transverse direction of said base; and two ribs extending in a forward/rearward direction of said base;

wherein a series of said outflow holes are arranged equidistantly within a substantially rectangular region defined by said transverse ribs and said forward/rearward ribs.

* * * * *